US009855642B2

(12) United States Patent
Wu

(10) Patent No.: US 9,855,642 B2
(45) **Date of Patent: *Jan. 2, 2018**

(54) EFFORT-SAVING LOCKING PLIERS

(71) Applicant: Ming Chieh Wu, Taichung (TW)

(72) Inventor: Ming Chieh Wu, Taichung (TW)

( * ) Notice: Subject to any disclaimer, the term of this patent is extended or adjusted under 35 U.S.C. 154(b) by 207 days.

This patent is subject to a terminal disclaimer.

(21) Appl. No.: 14/745,566

(22) Filed: Jun. 22, 2015

(65) Prior Publication Data

US 2015/0283681 A1 Oct. 8, 2015

Related U.S. Application Data

(63) Continuation-in-part of application No. 14/485,884, filed on Sep. 15, 2014, which is a continuation-in-part of application No. 13/469,469, filed on May 11, 2012, now Pat. No. 8,950,299.

(30) Foreign Application Priority Data

Jul. 12, 2011 (TW) ..... 100124592 A

(51) Int. Cl.
*B25B 7/12* (2006.01)

(52) U.S. Cl.
CPC ..... *B25B 7/123* (2013.01)

(58) Field of Classification Search
CPC ..... B25B 7/123; B25B 7/14; B25B 7/16
USPC ..... 81/379
See application file for complete search history.

(56) References Cited

U.S. PATENT DOCUMENTS

| | | | |
|---|---|---|---|
| 1,867,912 | A | 2/1931 | Evey |
| 2,519,630 | A | 8/1950 | Boyer |
| 3,262,343 | A | 7/1966 | Weller |
| 3,710,658 | A | 1/1973 | Wilson |
| 3,894,451 | A | 7/1975 | Putsch |
| 4,499,797 | A | 2/1985 | Wilson |
| 4,989,479 | A | 2/1991 | Anderson et al. |

(Continued)

FOREIGN PATENT DOCUMENTS

| | | |
|---|---|---|
| CN | 101659014 | 3/2010 |
| CN | 101704227 | 5/2010 |

(Continued)

OTHER PUBLICATIONS

European Search Report from European Application 12170983.6-1251, dated Oct. 22, 2012, 7 pages.

*Primary Examiner* — Hadi Shakeri
(74) *Attorney, Agent, or Firm* — Alan D. Kamrath; Kamrath IP Lawfirm, P.A.

(57) ABSTRACT

A pair of locking pliers includes a first grip structure including a first jaw and an adjustment screw connected to a first handle. A second grip structure cooperates with the first grip structure. The second grip includes a second jaw pivotally connected to the first handle about a first pivot axis and a second handle pivotally connected to the second jaw about a second pivot axis. A lock mechanism is pivotally connected to the second handle about a third pivot axis. The lock mechanism abuts the adjustment screw which restrains the lock mechanism to the first handle. The second handle extends longitudinally and terminates at an end at a first length from the second pivot axis. A second length measures a distance between the second and third pivot axes. The second length is smaller than 0.19 times of the first length.

12 Claims, 6 Drawing Sheets

(56) References Cited

U.S. PATENT DOCUMENTS

| | | | | |
|---|---|---|---|---|
| 5,056,385 | A * | 10/1991 | Petersen | B25B 7/123 81/367 |
| 5,351,585 | A | 10/1994 | Leseberg et al. | |
| 5,456,144 | A | 10/1995 | Dahl et al. | |
| 5,460,065 | A | 10/1995 | Balmer | |
| 5,520,040 | A | 5/1996 | Pettersson | |
| 6,393,951 | B1 | 5/2002 | Jannson | |
| 6,626,070 | B2 | 9/2003 | Peperkorn et al. | |
| 6,862,962 | B1 | 3/2005 | Delbrugge, Jr. et al. | |
| 7,143,671 | B1 | 12/2006 | Lai | |
| 7,216,570 | B2 | 5/2007 | Seber et al. | |
| 7,454,999 | B2 | 11/2008 | Wu | |
| 7,472,632 | B2 * | 1/2009 | Engvall | B25B 7/123 81/370 |
| 7,861,622 | B2 | 1/2011 | Chervenak et al. | |
| 8,056,451 | B2 * | 11/2011 | Chervenak | B25B 7/10 81/318 |
| D651,060 | S | 12/2011 | Chervenak et al. | |
| 8,225,700 | B2 | 7/2012 | Hile | |
| 8,479,618 | B2 | 7/2013 | Hsiao | |
| 8,950,299 | B2 | 2/2015 | Wu | |
| 2002/0162427 | A1 * | 11/2002 | Peperkorn | B25B 7/123 81/370 |
| 2007/0209484 | A1 | 9/2007 | Chervenak et al. | |
| 2008/0196561 | A1 | 8/2008 | Wu | |
| 2010/0018361 | A1 | 1/2010 | Chervenak et al. | |
| 2012/0073409 | A1 | 3/2012 | Hsiao | |
| 2013/0239759 | A1 | 9/2013 | Huang | |
| 2014/0251093 | A1 | 9/2014 | Lai | |

FOREIGN PATENT DOCUMENTS

| | | | |
|---|---|---|---|
| CN | 101704227 | A | 5/2010 |
| CN | 103624725 | A | 3/2014 |
| EP | 2149428 | A1 | 2/2010 |
| JP | H01106166 | U | 7/1989 |
| TW | 239357 | | 1/1995 |
| TW | M265172 | | 5/2005 |
| TW | M288585 | U | 3/2006 |
| TW | M313580 | | 6/2007 |
| TW | M313580 | U | 6/2007 |
| TW | I294819 | B | 3/2008 |
| TW | 200924914 | | 6/2009 |
| TW | M400919 | | 4/2011 |
| TW | I472412 | B | 2/2015 |

* cited by examiner

EFFORT-SAVING LOCKING PLIERS

CROSS REFERENCE TO RELATED APPLICATION

The present application is a continuation-in-part application of U.S. patent application Ser. No. 14/485,884 filed on Sep. 15, 2014, of which the disclosure is incorporated herein.

BACKGROUND OF THE INVENTION

1. Field of the Invention

This invention relates to a pair of locking pliers and, more particularly to a pair of effort-saving locking pliers.

2. Description of the Related Art

TW Pat. No. I411498 shows a pair of locking pliers including two jaws, two handles connected respectively to the two jaws, and a locking mechanism connected between the two handles. The handles can be squeezed to close the jaws. The pair of locking pliers can be locked to an object, with the locking mechanism causing the jaws to be clamped to the object. However, a great effort is still needed to release the pair of locking pliers from the clamped object.

The present invention is, therefore, intended to obviate or at least alleviate the problems encountered in the prior art.

SUMMARY OF THE INVENTION

It is an objective of the present invention to provide a pair of effort-saving locking pliers. The pair of locking pliers includes a first grip structure including a first handle, a first jaw connected to and fixedly disposed on the first handle, and an adjustment screw connected to the first handle and being movable to various fixed positions on the first handle. A second grip structure cooperates with the first grip structure. The second grip includes a second jaw pivotally connected to the first handle about a first pivot axis and a second handle pivotally connected to the second jaw about a second pivot axis. The second jaw is pivotal relative to and faces the first jaw. A lock mechanism is connected between the first and second handles. The lock mechanism is pivotally connected to the second handle about a third pivot axis. The lock mechanism abuts the adjustment screw which restrains the lock mechanism to the first handle. A biasing member is connected between the first handle and the second jaw. The second handle extends longitudinally and terminates at an end at a first length from the second pivot axis. A second length measures a distance between the second and third pivot axes. The second length is smaller than 0.19 times of the first length.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
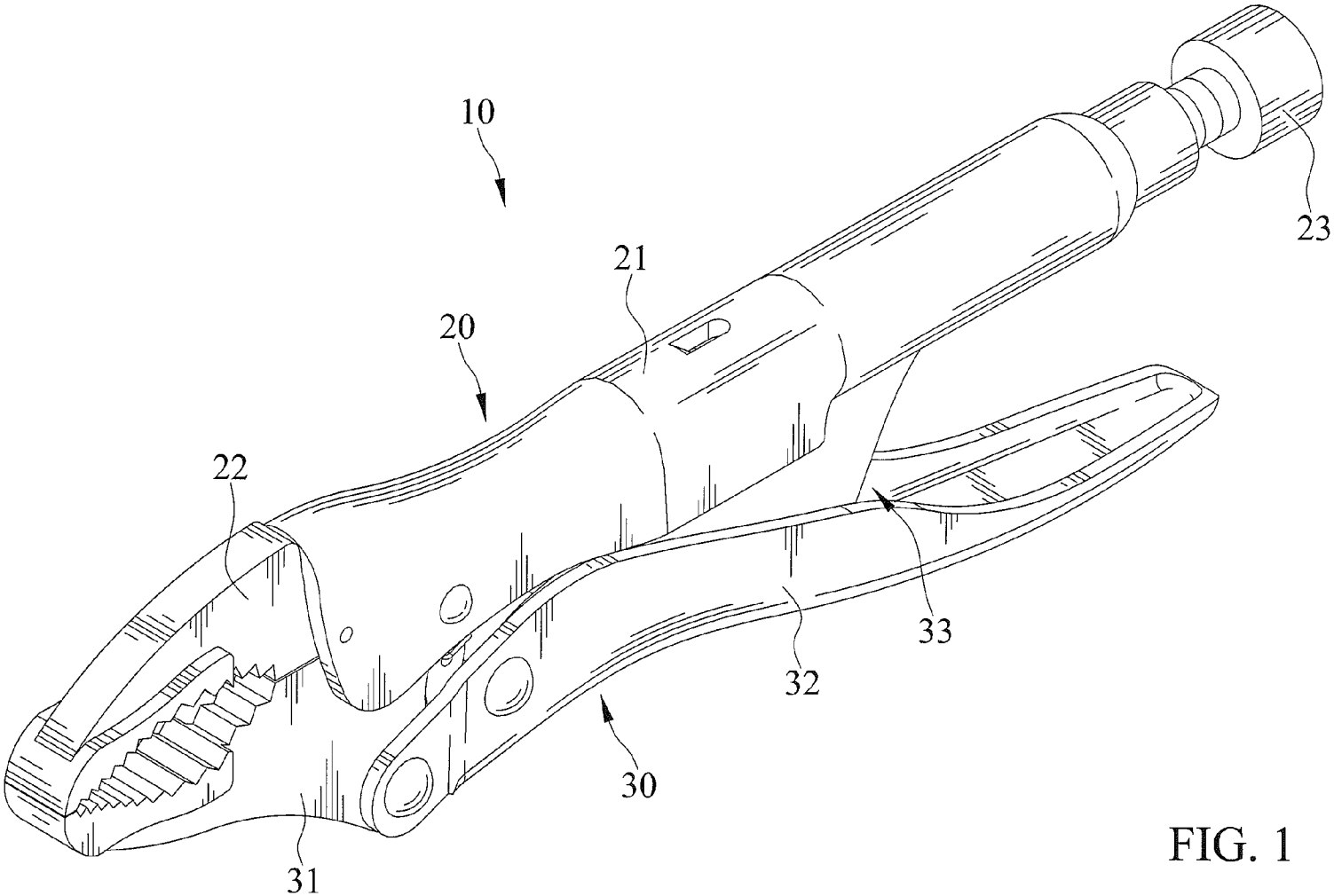
FIG. 1 is a perspective view of a pair of locking pliers in accordance with a first embodiment of the present invention, with the pair of locking pliers in a locked position, and with the pair of locking pliers prevented from moving out of the locked position.
Figure 2:
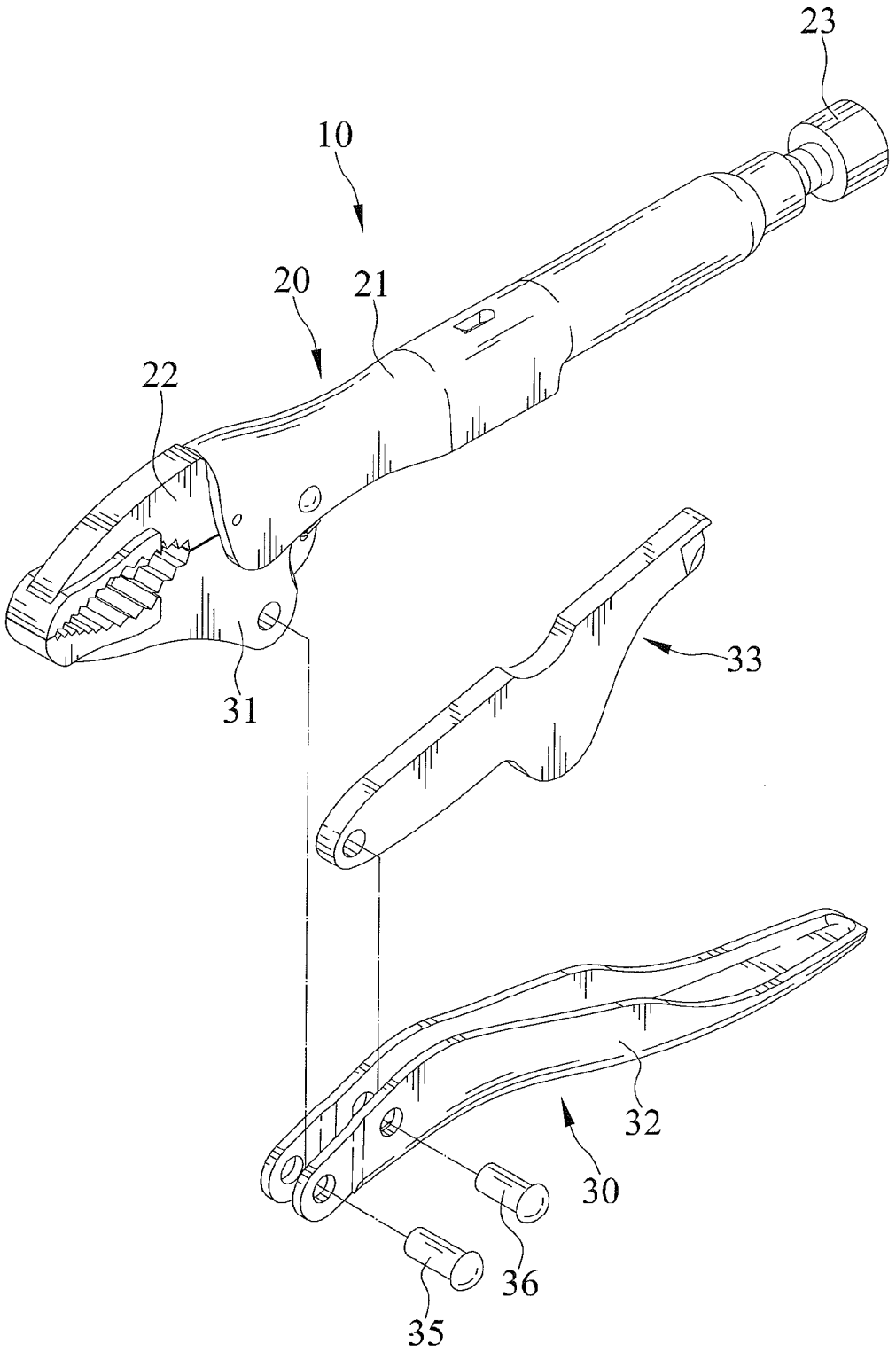
FIG. 2 is an exploded, perspective view of the pair of locking pliers shown in FIG. 1.
Figure 3:
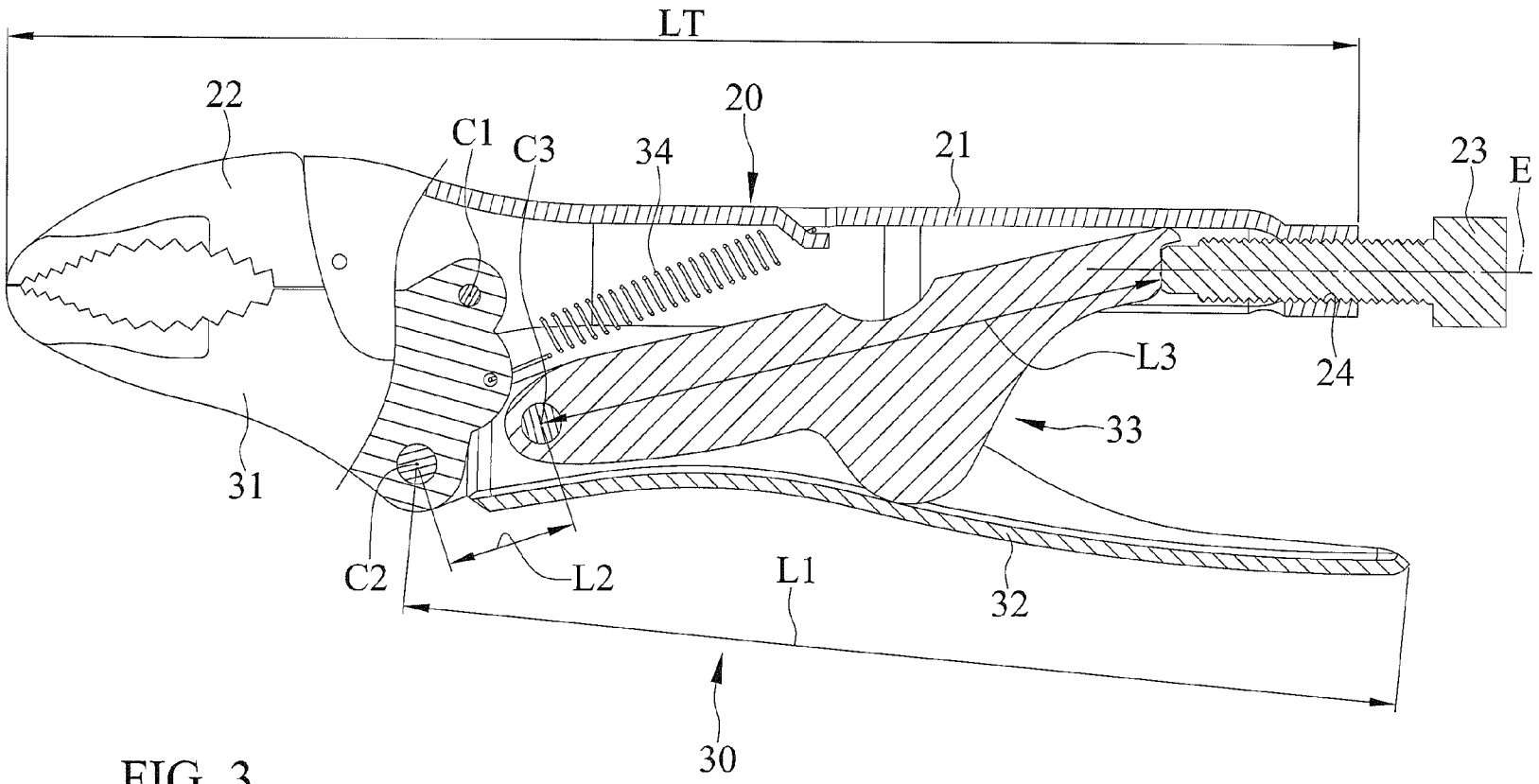
FIG. 3 is a partial, cross-sectional view of the pair of locking pliers shown in FIG. 1.

FIGS. 1 through 3 show a pair of locking pliers 10 according to a first embodiment of the present invention. The pair of locking pliers 10 includes a first grip structure 20, a second grip structure 30, a lock mechanism 33, and a biasing member 34.

The first grip structure 20 includes a first handle 21, a first jaw 22 connected to and fixedly disposed on the first handle 21, and an adjustment screw 23 connected to the first handle 21 and being movable to various fixed positions on the first handle 21. The first handle 21 has two opposite ends. The first jaw 22 and the adjustment screw 23 are at opposite ends of the first handle 21. The first handle 21 extends in a lengthwise direction from a first end to a second end thereof. The first jaw 22 extends in a lengthwise direction from a first end to a second thereof. The first handle 21 includes the first end thereof connected to the second end of the first jaw 22. The first end of the first jaw 22 is at a first distal end of the pair of locking pliers 10, and the second end of the first handle 21 is at a second distal end of the pair of locking pliers 10, respectively. The pair of locking pliers 10 measures a longitudinal length LT from the first end of the first jaw 22 to the second end of the first handle 21. The first handle 21 has a thread hole 24 extending therein. The adjustment screw 23 is threadably engaged with the thread hole 24 about an axis E. The first jaw 22 includes a first plurality of teeth. A first phantom line joining apexes of the first plurality of teeth is curved.

The second grip structure 30 cooperates with the first grip structure 20. The second grip structure 30 includes a second jaw 31 pivotally connected to the first handle 21 about a first pivot axis C1 and faces the first jaw 22. The first pivot axis C1 is defined on a fastener engaging the second jaw 31 and the first handle 21. The fastener inserts through a hole extending through the second jaw 31 and a hole extending through the first handle 21. The second grip structure 30 also includes a second handle 32 pivotally connected to the second jaw 31 about a second pivot axis C2. The first pivot axis C1 is parallel to the second pivot axis C2. The second handle 32 has a structure including a base seat and a pair of wings extending from the base seat. The base seat and the pair of wings cooperate to form a concavity. The second pivot axis C2 is defined on a fastener 35 inserting through a hole extending through the second jaw 31 and a hole extending through the wings of the second handle 32. The second jaw 31 includes a second plurality of teeth. A second phantom line joining apexes of the second plurality of teeth is curved.

The lock mechanism 33 is connected between the first and second handles 21 and 32. The lock mechanism 33 is pivotally connected to the second handle 32 about a third pivot axis C3. The third pivot axis C3 is parallel to the second pivot axis C2. The third pivot axis C3 is defined on a fastener 36 inserting through a hole extending through the second handle 32 and a hole extending through the lock mechanism 33. The lock mechanism 33 abuts the adjustment screw 23 which restrains the lock mechanism 33 to the first handle 21. The lock mechanism 33 is a linkage made in one piece. The lock mechanism 33 includes a protrusion extending rearward therefrom. The protrusion releasably abuts the second handle 32.

The biasing member 34 connected between the first handle 21 and the second jaw 31. The biasing member 34 has two opposite distal ends. The biasing member 34 includes a first distal end thereof hooked to a protrusion of the first handle 21 and a second end thereof hooked to a hole recessing on the tail end of the second jaw 31.

The pair of locking pliers 10 is movable between an open position in which the second jaw 31 is disposed distal to the first jaw 22 and in which an opening of a first size is delimited between the first and second jaws 22 and 31, and a locked position in which the second jaw 31 is disposed closer to the first jaw 22 and in which the size of the opening is reduced. The pair of locking pliers 10 moved to the open position thereof includes the second pivot axis C2, the third pivot axis C3, and an end of the lock mechanism adjacent to the adjustment screw 23 not aligned. The pair of locking pliers 10 moved to the locked position thereof includes the lock mechanism 33 disposed in an overcenter lock position in which the second pivot axis C2, the third pivot axis C3 and the end of the lock mechanism adjacent to the adjustment screw 23 substantially aligned. The pair of locking pliers 10 moved to the locked position thereof includes the first ends of the first and second jaws 22 and 31 aligned with each other. The pair of locking pliers 10 moved to the open position thereof includes the protrusion not in contact with the second handle 32. The pair of locking pliers 10 moved to the locked position thereof includes the protrusion in contact with the second handle 32.

The second handle 32 extends longitudinally and terminates at an end at a first length L1 from the second pivot axis C2. A second length L2 measures a distance between the second and third pivot axes C2 and C3. The second length L2 is smaller than 0.19 times of the first length L1. Preferably, the second length L2 is smaller than 0.15 times and greater than 0.1 times of the first length L1. Preferably, the second length L2 is smaller than 0.14 times and greater than 0.13 times of the first length L1.

In addition, the lock mechanism 33 terminates at an end abutting the adjustment screw 23 at a third length L3 from the third pivot axis C3. The third length L3 is greater than 0.6 times of the first length L1. Preferably, the third length L3 is smaller than 0.75 times of the first length L1. Preferably, the third length L3 is greater than 0.65 times and smaller than 0.7 times of the first length L1.

Furthermore, the first length L1 is smaller than 0.8 times and greater than 0.7 times of the longitudinal length LT.

The pair of locking pliers 10 includes the second length L2 thereof smaller than 0.19 times of the first length L1 thereof to be effort-saving. The effort-saving pair locking pliers 10 in the locked position thereof allows an object to be clamped tightly between the first and second jaws 22 and 31. It is effort-saving to release the pair of locking pliers 10 from the clamped object.

Figure 4:
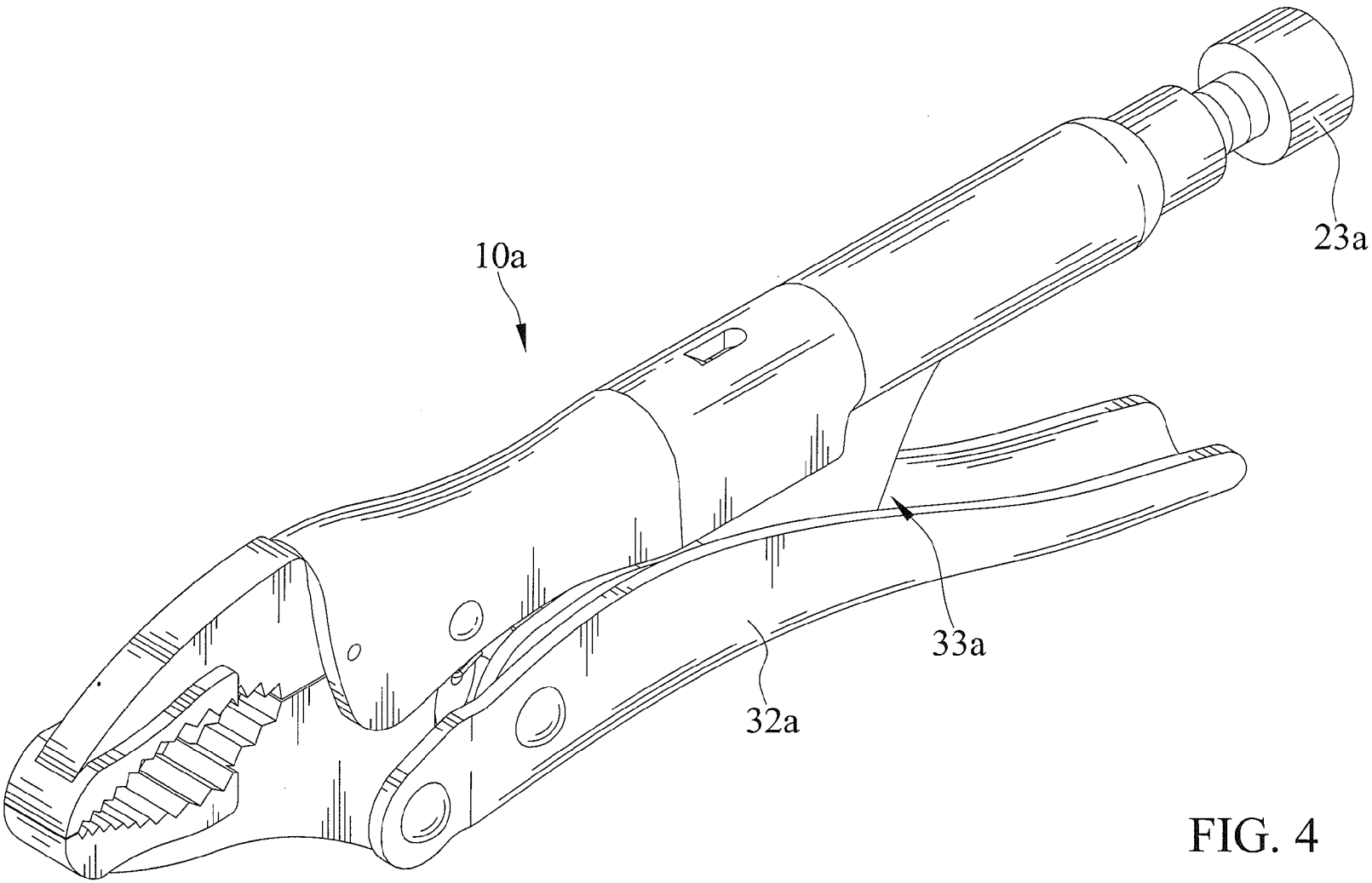
FIG. 4 is a perspective view of a pair of locking pliers in accordance with a second embodiment of the present invention, with the pair of locking pliers in a locked position, and with the pair of locking pliers prevented from moving out of the locked position.
Figure 5:
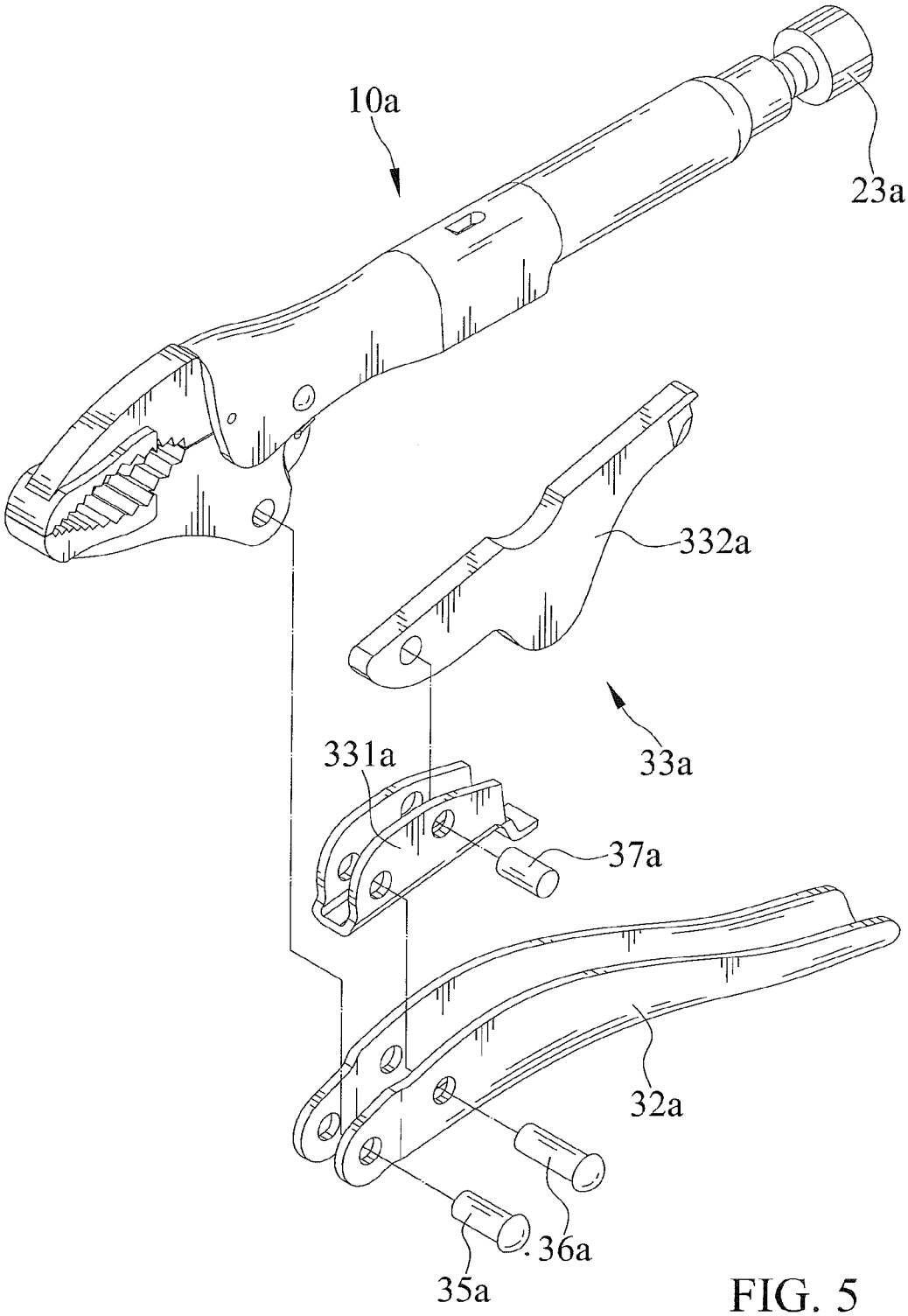
FIG. 5 is an exploded, perspective view of the pair of locking pliers shown in FIG. 4.
Figure 6:
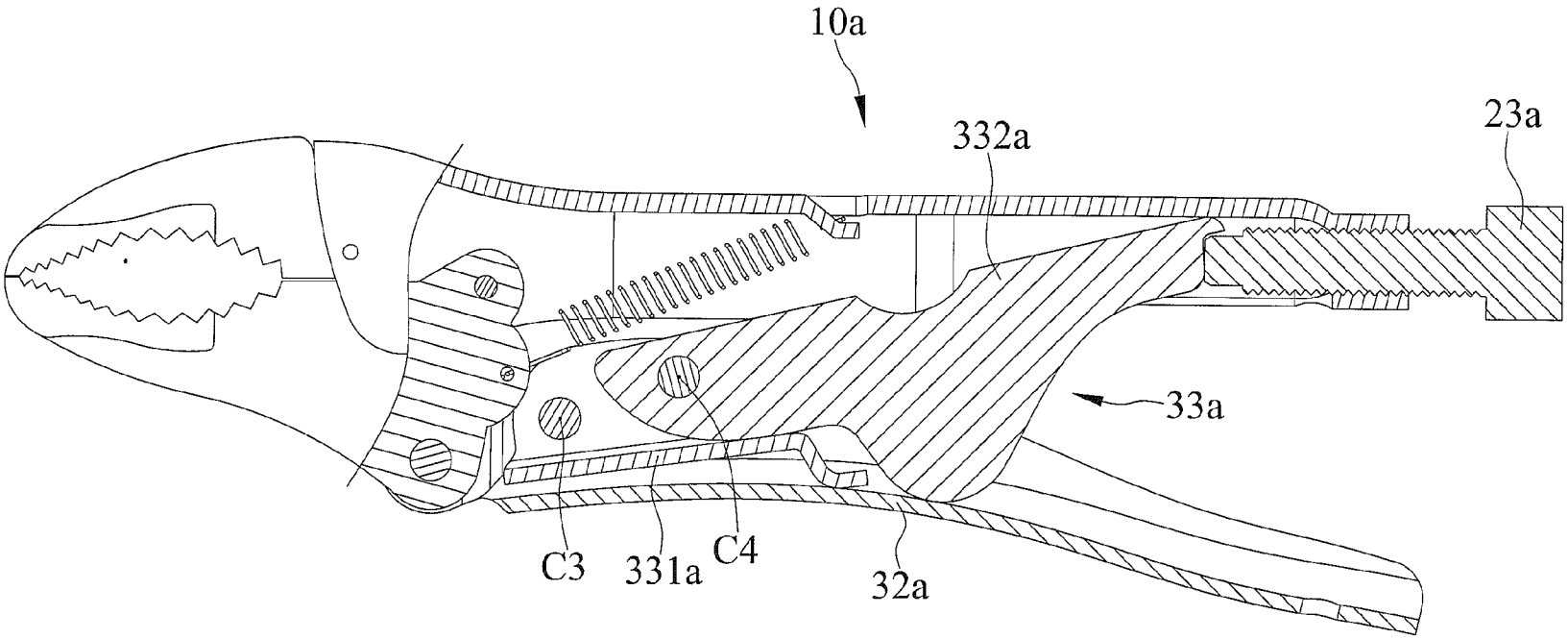
FIG. 6 is a partial, cross-sectional view of the pair of locking pliers shown in FIG. 4.

FIGS. 4 through 6 show a pair of locking pliers 10*a* according to a second embodiment of the present invention, and the same numbers are used to correlate similar components of the first embodiment, but bearing a letter a. The second embodiment is the same as the first embodiment except that a lock mechanism 33*a* replaces the lock mechanism 33. The second embodiment has the same arrangements and geometries as the first embodiment. Therefore, similarity is not described repeatedly.

The lock mechanism 33*a* includes a first linkage 331*a* and a second linkage 332*a* pivotally connected to the first linkage 331*a* about a fourth pivot axis C4. The fourth pivot axis C4 is parallel to the third pivot axis C3. The first linkage 331*a* is pivotally connected to the second handle 32*a* about the third pivot axis C3 defined by a fastener 36*a* and to the second pivot C2 defined by a fastener 35*a*. The first linkage 331*a* includes a lower wall and a pair of side walls extending in the transverse direction from the lower wall. The second linkage 332*a* is pivotally connected between the pair of side walls. The fourth pivot axis C4 is defined on a fastener 37*a* inserting through a hole extending through the side walls of the first linkage 331 and a hole extending through a head end of the second linkage 332*a*. The first linkage 331*a* includes a power end which is spaced from the lower wall in a transverse direction. The power end releasably abuts the second handle 32*a*. The second linkage 332*a* includes a protrusion extending rearward therefrom. The protrusion releasably abuts the second handle 32*a*. The adjustment screw 23*a* abuts the second linkage 332*a*.

The pair of locking pliers 10*a* moved to an open position thereof includes the power end not in contact with the base seat. The pair of locking pliers moved to a locked position thereof includes power end in contact with the base seat.

In view of the forgoing, the effort-saving pair of locking pliers 10 or 10*a* includes the second length L2 thereof smaller than 0.19 times of the first length L1 thereof. The effort-saving pair locking pliers 10 or 10*a* in the locked position thereof allows an object to be clamped tightly between the first and second jaws 22 and 31. It is effort-saving to release the pair of locking pliers 10 or 10*a* from the clamped object.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

What is claimed is:

1. A pair of locking pliers comprising:

a first grip structure including a first handle, a first jaw connected to and fixedly disposed on the first handle, and an adjustment screw connected to the first handle and being movable to various fixed positions on the first handle;

a second grip structure cooperating with the first grip structure, including a second jaw pivotally connected to the first handle about a first pivot axis and facing the first jaw, and including a second handle pivotally connected to the second jaw about a second pivot axis;

a lock mechanism connected between the first and second handles, pivotally connected to the second handle about a third pivot axis, and abutting the adjustment screw which restrains the lock mechanism to the first handle; and a biasing member connected between the first handle and the second jaw;

wherein the second handle extends longitudinally and terminates at an end at a first length from the second pivot axis;

wherein a second length measures a distance between the second and third pivot axes;

wherein the second length is smaller than 0.14 times and greater than 0.13 times of the first length;

wherein the lock mechanism terminates at an end abutting the adjustment screw at a third length from the third pivot axis; and wherein the third length is greater than 0.6 times of the first length.

2. The pair of locking pliers as claimed in claim 1, wherein the third length is smaller than 0.75 times of the first length.

3. The pair of locking pliers as claimed in claim 2, wherein the third length is greater than 0.65 times and smaller than 0.7 times of the first length.

4. The pair of locking pliers as claimed in claim 1, wherein the first jaw extends in a lengthwise direction from a first end to a second thereof, wherein the first handle extends in a lengthwise direction from a first end to a second end thereof, wherein the first handle includes the first end thereof connected to the second end of the first jaw, wherein the first end of the first jaw is at a first distal end of the pair of locking pliers and the second end of the first handle is at a second distal end of the pair of locking pliers respectively, wherein the pair of locking pliers measures a longitudinal length from the first end of the first jaw to the second end of the first handle, and wherein the first length is smaller than 0.8 times and greater than 0.7 times of the longitudinal length.

5. The pair of the locking pliers as claimed in claim 1, wherein the pair of locking pliers is movable between an open position in which the second jaw is disposed distal to the first jaw and in which an opening of a first size is delimited between the first and second jaws, and a locked position in which the second jaw is disposed closer to the first jaw and in which the first size of the opening is reduced, and wherein the pair of locking pliers moved to the locked position thereof includes the lock mechanism disposed in an overcenter lock position in which the second pivot axis, the third pivot axis and an end of the lock mechanism adjacent to the adjustment screw are substantially aligned.

6. The pair of locking pliers as claimed in claim 1, wherein the lock mechanism includes a first linkage and a second linkage pivotally connected to the first linkage about a fourth pivot axis, wherein the first linkage is pivotally connected to the second handle about the third pivot axis, wherein the first linkage includes a lower wall and a power end which is spaced from the lower wall in a transverse direction, wherein the power end releasably abuts the second handle, and wherein the adjustment screw abuts the second linkage.

7. The pair of locking pliers as claimed in claim 6, wherein the first linkage includes a pair of side walls extending in the transverse direction from the lower wall, and wherein the second linkage is pivotally connected between the pair of side walls.

8. The pair of locking pliers as claimed in claim 5, wherein the lock mechanism includes a protrusion extending rearward therefrom, wherein the protrusion releasably abuts the second handle, wherein the pair of locking pliers moved to the open position thereof includes the protrusion not in contact with the second handle, and wherein the pair of locking pliers moved to the locked position thereof includes the protrusion in contact with the second handle.

9. The pair of locking pliers as claimed in claim 8, wherein the protrusion extends from the second linkage.

10. The pair of locking pliers as claimed in claim 1, wherein the first handle has a thread hole extending therein, and wherein the adjustment screw is threadably engaged with the thread hole.

11. The pair of locking pliers as claimed in claim 1, wherein the second handle has a structure including a base seat and a pair of wings extending from the base seat, wherein the base seat and the pair of wings cooperate to form a concavity.

12. The pair of locking pliers as claimed in claim 1, wherein the first jaw includes a first plurality of teeth, wherein a first phantom line joining apexes of the first plurality of teeth is curved, wherein the second jaw includes a second plurality of teeth, and wherein a second phantom line joining apexes of the second plurality of teeth is curved.

* * * * *